US009427767B2

(12) United States Patent
Tsuchida et al.

(10) Patent No.: US 9,427,767 B2
(45) Date of Patent: Aug. 30, 2016

(54) APPARATUS FOR APPLYING COATING LIQUID AND COATING BAR

(71) Applicant: Panasonic Corporation, Kadoma-shi, Osaka (JP)

(72) Inventors: Shuzo Tsuchida, Nara (JP); Isao Muragisi, Osaka (JP); Akihiro Horikawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 219 days.

(21) Appl. No.: 13/754,184

(22) Filed: Jan. 30, 2013

(65) Prior Publication Data

US 2013/0220218 A1 Aug. 29, 2013

(30) Foreign Application Priority Data

Feb. 23, 2012 (JP) ..... 2012-036891

(51) Int. Cl.
*B05C 11/02* (2006.01)
*B05C 5/02* (2006.01)

(52) U.S. Cl.
CPC ..... *B05C 11/025* (2013.01); *B05C 5/0254* (2013.01)

(58) Field of Classification Search
None
See application file for complete search history.

(56) References Cited

U.S. PATENT DOCUMENTS

| | | | | |
|---|---|---|---|---|
| 4,870,920 | A * | 10/1989 | Kageyama et al. | 118/103 |
| 5,383,968 | A * | 1/1995 | Rantanen et al. | 118/119 |
| 7,402,209 | B2 | 7/2008 | Ishida et al. | |
| 7,527,691 | B2 | 5/2009 | Ando et al. | |
| 2004/0144305 | A1* | 7/2004 | Ando et al. | 118/208 |

FOREIGN PATENT DOCUMENTS

| | | |
|---|---|---|
| JP | 62-183586 U | 11/1987 |
| JP | 8-506525 | 7/1996 |
| JP | 9-201563 | 8/1997 |
| JP | 2001-087697 | 4/2001 |
| JP | 2001-104852 | 4/2001 |
| JP | 2004-148204 | 5/2004 |
| JP | 2004-160307 | 6/2004 |
| JP | 2004-216323 | 8/2004 |
| JP | 2005-128320 | 5/2005 |
| JP | 2008-290032 | 12/2008 |
| JP | EP 2341185 | 7/2011 |
| JP | 2013-514880 | 5/2013 |
| WO | WO 95/16074 | 6/1995 |

* cited by examiner

*Primary Examiner* — Dah-Wei D Yuan
*Assistant Examiner* — Jethro M Pence
(74) *Attorney, Agent, or Firm* — Hamre, Schumann, Mueller & Larson, P.C.

(57) ABSTRACT

A coating bar 1 in a coating apparatus includes grooves 2 that are formed, on the surface of a cylindrical shaft, from a contact point between the coating bar 1 and a substrate 3 in a traveling direction and a direction opposite to the traveling direction, and are arranged in the width direction of the shaft. Thus, a uniform film can be stably applied to the curved or wavy substrate 3 having high rigidity.

10 Claims, 7 Drawing Sheets

FIG. 2

| $\alpha$ | $\beta$ | LIQUID OVERFLOW | UNEVEN COATING | AIR BUBBLES |
|---|---|---|---|---|
| 180 | 180 | YES | YES | NO |
| 90 | 30 | NO | NO | NO |
| 90 | 60 | NO | NO | NO |
| 90 | 90 | NO | YES | NO |
| 90 | 120 | NO | YES | NO |
| 30 | 60 | NO | NO | YES |
| 60 | 60 | NO | NO | YES |
| 120 | 60 | NO | NO | NO |

APPARATUS FOR APPLYING COATING LIQUID AND COATING BAR

FIELD OF THE INVENTION

The present invention relates to a coating apparatus and a coating bar used for the same.

BACKGROUND OF THE INVENTION

In a known coating technique, an antireflective coating and a wavelength tunable film for interrupting specific wavelength light are applied over a wide area for solar cells, display panels, and lighting apparatuses.

A representative technique is, for example, a bar-coating method. An invention of the bar-coating method is described in Japanese Utility Model Laid-Open No. 62-183586. FIG. 6 is a schematic diagram for explaining the conventional bar-coating method.

As illustrated in FIG. 6, in the bar-coating method, a long bar 111 is first set in a coating width direction, and a coating liquid 114 is then supplied onto a substrate 113 from a separately provided dispenser nozzle 112. After that, the substrate 113 and the bar 111 in contact with the substrate 113 are relatively moved in a lateral direction to spread an excessive coating liquid in a scraping manner, leaving a predetermined volume of the coating liquid 114 on the substrate 113 so as to evenly form a thin film. Hereinafter, the dispenser nozzle 112 is located upstream while the coating liquid 114 scraped into a uniform film is located downstream with respect to the bar 111.

The surface of the bar 111 has small asperities. The coating liquid 114 is left on the substrate 113 such that the coating liquid 114 is as thick as gaps between the asperities and a substrate surface. Thus, a film thickness is adjusted by changing the size of the asperities.

As a bar used for the bar-coating method, a known bar shape is shown in, for example, Japanese Patent Laid-Open No. 2004-148204. FIGS. 7A and 7B are schematic diagrams illustrating the structure of a conventional bar. FIG. 7A is a side view of the bar. FIG. 7B is a cross-sectional view of the bar. A bar 111 illustrated in FIGS. 7A and 7B includes a wire 116 wound around a shaft 115, the wire 116 having a predetermined diameter. A coating liquid 114 is left on a substrate 113 according to a gap 117 formed between asperities on the wire 116 and the substrate 113, enabling coating with a constant thickness.

DISCLOSURE OF THE INVENTION

In the bar-coating method, however, the bar needs to be in contact with the substrate in the width direction of the bar.

As is understood from FIG. 7A, a necessary condition for the bar-coating method is that the substrate 113 is in contact with the asperities formed by the wire 116 on the surface of the bar 111 and only the gap 117 is opened. For the necessary condition, the overall bar 111 needs to be in contact with the substrate 113. To be specific, the substrate 113 coated with a coating liquid needs to be less rigid like a film and extend along the bar 111, the substrate 113 needs to be flat, or a curve on the substrate 113 needs to be corrected by, for example, suction to a stage. In other words, a space other than the gap 117 may be formed between the substrate 113 and the bar 111 in the conventional bar-coating method. Thus, it is difficult to apply the conventional bar-coating method to a substrate having high rigidity and low flatness, e.g., a thick glass substrate.

Hence, the tracking of the bar 111 to the substrate 113 may be improved by reducing the rigidity and cross-sectional area of the bar.

However, in the case where the bar 111 has a small diameter in cross section, the coating liquid 114 supplied onto the substrate 113 may flow over the bar 111 as illustrated in FIG. 7B.

Specifically, in the case where the bar 111 has a small diameter, the coating liquid 114 flows upward (arrow 120 in FIG. 7B) along grooves on the surface of the bar 111 because of the surface tension of the coating liquid 114 and a pressure for scraping the coating liquid 114. The coating liquid 114 then flows to a downstream side 119 of the bar 111 and reaches a coating surface (arrow 121 in FIG. 7B). Hence, a coating film may be varied in thickness or variations in thickness may increase.

The present invention is devised to solve the conventional problem. An object of the present invention is to stably apply a uniform film even on a curved or wavy substrate having high rigidity.

BRIEF DESCRIPTION OF THE DRAWINGS

FIG. 2 is a table showing the relationship between a groove forming angle and a coating film according to the first embodiment;

DESCRIPTION OF THE EMBODIMENTS

Embodiments of the present invention will be described below with reference to the accompanying drawings.

First Embodiment

Figure 1A:
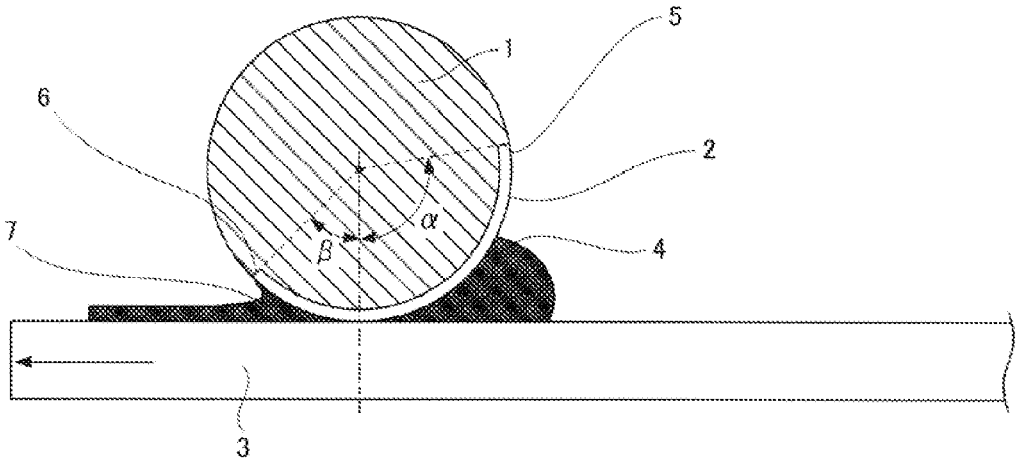
FIG. 1A is a schematic diagram illustrating the shape of a coating bar according to a first embodiment.
Figure 1B:
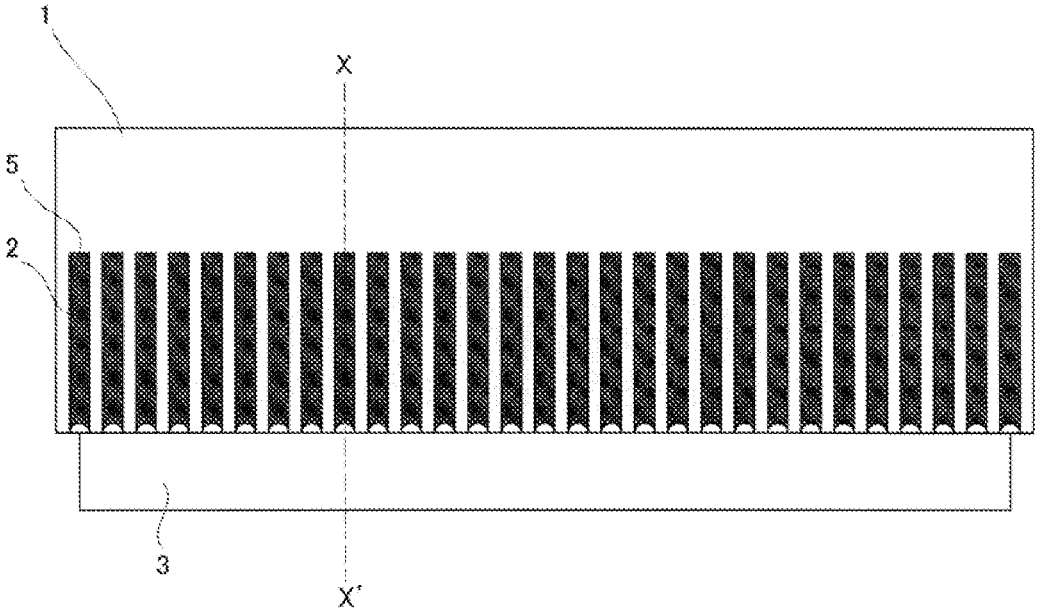
FIG. 1B is a schematic diagram illustrating the shape of the coating bar according to the first embodiment.

FIGS. 1A and 1B are schematic diagrams illustrating the shape of a coating bar according to a first embodiment. FIG. 1A is a cross-sectional view taken along line X-X' of FIG. 1B. FIG. 1B is a side view. In FIGS. 1A and 1B, grooves 2 formed in a circumferential direction are arranged over a coating width on the shaft surface of a coating bar 1. The grooves 2 are formed only on a part of the outer surface of the shaft in the cross section of the shaft. In other words, the groove 2 is shorter than the circumference of the shaft. In this case, a method for forming the grooves 2 is not particularly limited, and thus the grooves 2 can be formed by cutting, electroforming, or plating on the shaft.

A structural example of a coating apparatus including the coating bar will be specifically described below.

Figure 8:
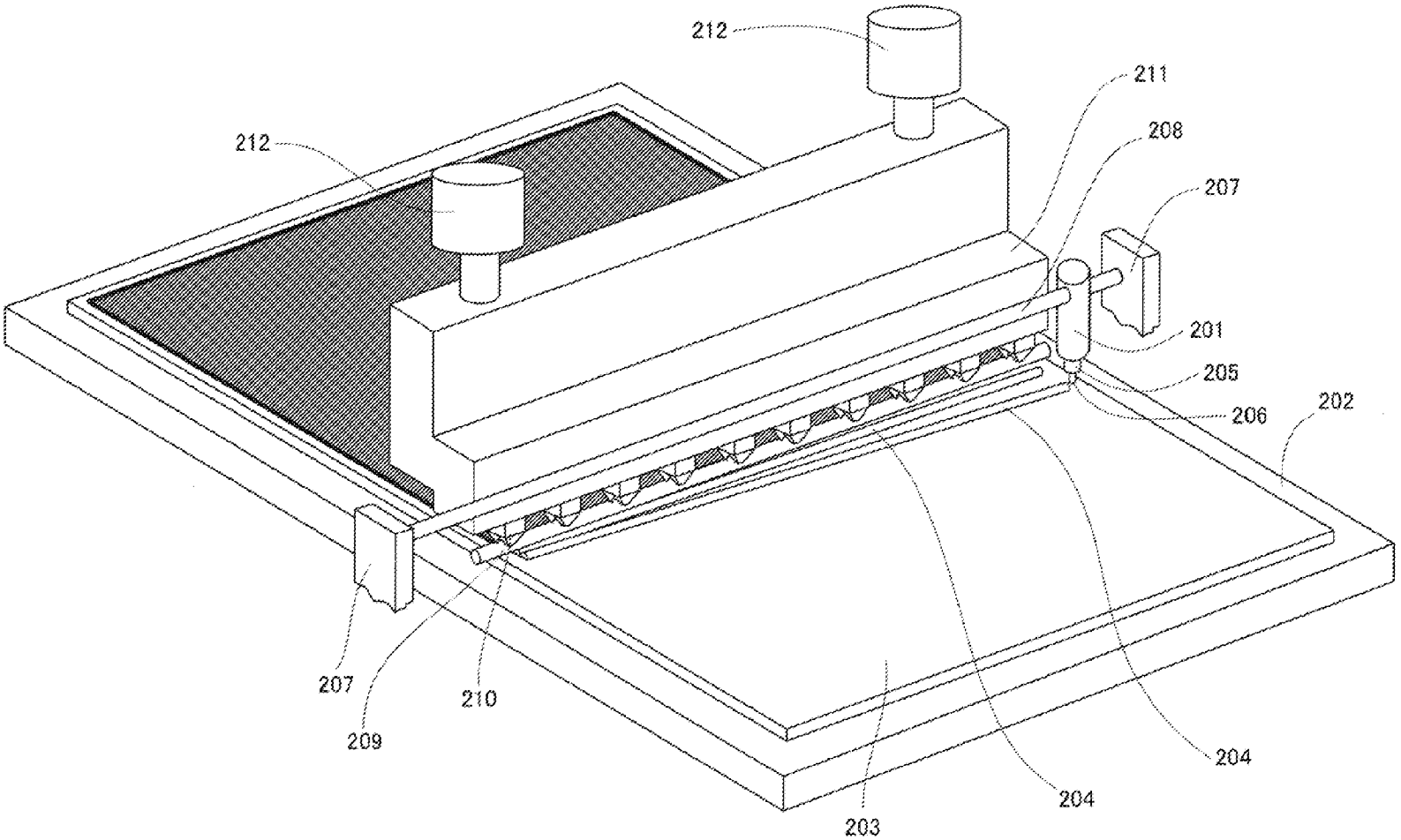
FIG. 8 is a perspective view illustrating the configuration of a coating apparatus including a coating bar.

FIG. 8 is a perspective view illustrating the configuration of the coating apparatus including the coating bar. The coating apparatus includes a feeding device 201 that feeds a required amount of a coating liquid 204 in the width direction of a substrate 203 onto the substrate 203 installed on a substrate holding stage 202. The feeding device 201 is connected to a ball screw 208 whose ends are held by vertically moving support members 207. With this configuration, the feeding device 201 can be moved in the width direction of the substrate 203, enabling coating in the width direction of the substrate 203. The end of the feeding device 201 in FIG. 8 has a dispenser provided with a feeding needle 206 on the end of a syringe 205. The feeding device 201 may include a coating liquid dispenser nozzle (e.g., a die coat) extended in the width direction of the substrate.

A coating bar 209 that scrapes an excessive amount of the coating liquid 204 in the longitudinal direction is installed in the width direction of the substrate 203. A holding/pressing device 211 is provided to press the coating bar 209 to the surface of the substrate 203. According to a specific example, the coating bar 209 is held by a plurality of holding chucks 210, each including a pressing device (not shown) capable of pressing the coating bar 209 with a predetermined pressure by means of an elastic material such as rubber, a spring, and an air pressure.

Elevating devices 212 are provided to move up and down the holding/pressing device 211 such that the coating bar 209 and the substrate 203 are not in contact with each other when the coating liquid 204 is not applied, for example, during replacement of the substrate 203.

According to the present invention, the coating bar 209 in contact with the substrate 203 on a specific contact point is drawn without being rotated, thereby spreading the coating liquid 204 on the flat substrate 203 in a scraping manner. Grooves are partially formed around the outer surface of the coating bar 209 and are spaced at regular intervals. The grooves are formed so as to cover the contact point between the coating bar 209 and the substrate 203. The contact point is located on the outer surface of the coating bar 209 and on a straight line extended in parallel with the shaft of the coating bar 209. The contact point is a group of surfaces between the grooves on the coating bar 209 that comes into contact with the substrate 203 when the coating bar 209 is drawn.

In the following explanation, the substrate 203 is a cover glass for a solar cell. The cover glass for a solar cell has a large thickness of about 2 mm to 4 mm and thus cannot be easily bent like a glass substrate of 1 mm or less. Generally, a cover glass for a solar cell is formed by cooling molten glass pressed with a roller die, forming asperities. Thus, a stress is applied to the glass so as to form large curves or waves on the glass. Only a glass surface may be rapidly cooled from a high temperature to reinforce the glass, which may apply a thermal stress so as to form curves or waves on the cover glass for a solar cell on the order of millimeters.

Hence, in order to apply the bar-coating method to a cover glass for a solar cell, the coating bar 209 needs to track curves or waves on the order of millimeters. In response to curves and waves on the substrate 203, materials such as Al and Cu having lower rigidity are more desirably used than SUS to reduce the rigidity of the coating bar 209. The coating bar 209 is desirably circular in cross section with a diameter of about 2 mm to 6 mm to secure elasticity. This is because when the coating bar 209 is smaller in diameter than 2 mm, the coating bar 209 is hard to hold with the chucks 210, whereas when the coating bar 209 is larger than 6 mm in diameter, the coating bar 209 becomes too rigid to track curves or waves on the substrate 203. Another reason is that the coating bar 209 needs to be strongly pressed to the substrate 203 in response to curves or waves when the coating bar 209 is extremely rigid, leading to large wear on the coating bar 209. The rigidity of the coating bar 209 can be effectively reduced by optionally forming a hollow at the center of the shaft. The depth of the groove is determined according to the thickness of a coating film.

A mechanism (not shown) for pressing the coating bar 209 at predetermined intervals or pressing the overall coating bar 209 in the width direction with an elastic material such as rubber is provided to fix the coating bar 209 to the coating apparatus in a direction orthogonal to the coating surface of the substrate 203. With this configuration, the coating bar 209 can easily track curves or waves in the width direction of the substrate 203.

According to the coating bar and the coating apparatus of the present invention, the grooves 2 in FIGS. 1A and 1B are provided partially on the surface of the coating bar 209, thereby preventing an overflow of a coating liquid in a portion not including the grooves 2. Hence, a uniform coating film can be formed even on a curved or wavy rigid substrate having a large width of about 300 mm to 2000 mm. Even in the case where the coating bar is reduced in diameter to further track the substrate, an overflow of a coating liquid can be prevented so as to form a uniform coating film.

A positional relationship for forming the grooves on the coating bar will be described below. As illustrated in FIG. 1A, an angle $\alpha$ is formed by the formation region of the grooves 2 in the relative traveling direction (upstream) of the coating bar 1 from a contact point between the coating bar 1 and a substrate 3 while an angle $\beta$ is formed by the grooves 2 in a direction opposite to the relative traveling direction of the coating bar 1 (downstream) from the contact point between the coating bar 1 and the substrate 3. Referring to FIG. 2, visual observation results on the quality of a coating film with varying angles $\alpha$ and $\beta$ will be described below.

FIG. 2 is a table showing the relationship between a groove forming angle and a coating film according to the first embodiment. In this table, a used coating liquid contained a material that forms an antireflective coating after drying and burning, according to the formation conditions of an antireflective coating in a typical solar cell. Moreover, a prime solvent was a solution containing a solvent with a viscosity of 2 mPa·s to 10 mPa·s. The coating bar in contact with the substrate on the contact point of the coating bar was drawn with a coating speed, that is, a constant relative traveling speed of 10 mm/s to 50 mm/s between the coating bar and the substrate.

First, the angle $\alpha$ was changed that is formed by the grooves 2 in the relative traveling direction (upstream) of the coating bar 1 from a contact point between the coating bar 1 and the substrate 3. As shown in FIG. 2, every time the angle $\alpha$ was changed to 30°, 60°, 90°, and 120° with the angle $\beta$ fixed at 60°, the occurrence of a flow of a coating liquid 4 over the coating bar 1 was reduced unlike in the case where the grooves 2 are formed around the outer surface of the coating bar 1. Moreover, it was confirmed that uneven coating caused for the reason was eliminated. In the case where the angle α was 30° and 60°, unfortunately, a coating film was likely to trap air bubbles.

Air bubbles are trapped as follows: first, ends 5 of the grooves 2 in contact with the coating liquid 4 are covered with the coating liquid 4, and then air bubbles trapped in the grooves 2 are contained in the coating liquid 4. The air bubbles are likely to remain on the ends 5, and the remaining air bubbles may be trapped on the surface of a coating film by vibrations or the like during coating.

In the case where the angle α is 90° and 120°, however, the ends 5 of the grooves 2 are always exposed upward (in the atmosphere) from the coating liquid 4, allowing air bubbles trapped in the grooves 2 to flow out of the ends 5. The ends 5 are located perpendicularly to the substrate 3 and thus are more likely to release air bubbles than in the case where the angle α is 30° and 60°. Air bubbles are left when the angle α is 30° and 60°, whereas air bubbles are not left when the angle α is 90° and 120°. When the angle α is larger than 120°, the coating liquid 4 is likely to flow over the coating bar 1 and adhere to the chucks, which may reduce the holding power of the chucks.

According to the results, under conditions equivalent to the formation conditions of an antireflective coating of a typical solar cell, the coating liquid contains a material that forms an antireflective coating after drying and burning, a prime solvent is a solution containing a solvent with a viscosity of 2 mPa·s to 10 mPa·s, and the coating bar is drawn with a coating speed, that is, a relative traveling speed of 10 mm/s to 50 mm/s between the coating bar and the substrate. In this case, the angle α of 90° to 120° is desirably formed by the grooves 2 in the relative traveling direction of the coating bar 1 from a contact point between the coating bar 1 and the substrate 3.

In the following explanation, the angle β was changed that forms the grooves 2 in the direction opposite to the relative traveling direction of the coating bar 1 (downstream) from a contact point between the coating bar 1 and the substrate 3. In the case where the angle α was fixed at 90° and the angle β was changed to 30°, 60°, 90°, and 120°, a uniform coating film was obtained when the angle β was 30° and 60°, whereas a coating film tended to vary in thickness when the angle β was 90° and 120°.

The reason may be considered as follows: the coating liquid 4 is moved upward along the grooves 2 by capillarity and is transported to ends 6 of the grooves 2 in a protruding manner, and the amount of a liquid pool 7 downstream of the coating bar 1 is varied by vibrations or the like during coating, resulting in uneven coating. When the angle β is 0°, the coating liquid 4 in contact with the substrate 3 does not open the grooves, precluding stable coating.

Thus, under conditions equivalent to the formation conditions of an antireflective coating of a typical solar cell, the coating liquid contains a material that forms an antireflective coating after drying and burning, a prime solvent is a solution containing a solvent having a viscosity of 2 mPa·s to 10 mPa·s, and the coating bar is drawn with a coating speed, that is, a relative traveling speed of 10 mm/s to 50 mm/s between the coating bar and the substrate. In this case, the angle β of 0° to 60° is desirably formed by the grooves 2 in the direction opposite to the relative traveling direction of the coating bar 1 (downstream) from a contact point between the coating bar 1 and the substrate 3.

As has been discussed, the coating bar of the coating apparatus is a cylindrical shaft having a small diameter in cross section. The grooves are partially formed on the surface of the shaft in the relative traveling direction of the coated substrate or in a direction opposite to the relative direction from a contact point between the coating bar and the substrate, and the grooves are arranged in the width direction of the shaft. Thus, a coating film is less varied in thickness or uneven coating is less likely to be formed by an overflow of the coating liquid or the liquid pool, so that the film can be stably and evenly applied to a curved or wavy substrate having high rigidity.

Second Embodiment

According to a second embodiment, a coating bar used for a coating apparatus has gaps between wires wound around the coating bar. The gaps serve as the grooves of the first embodiment. The grooves are partially covered with a coating material such as resin and rubber so as to form an exposed region on the gaps serving as the grooves.

Referring to FIGS. 3A, 3B, 4A, and 4B, the coating bar having a different structure from the coating bar of the first embodiment will be described below.

Figure 3A:
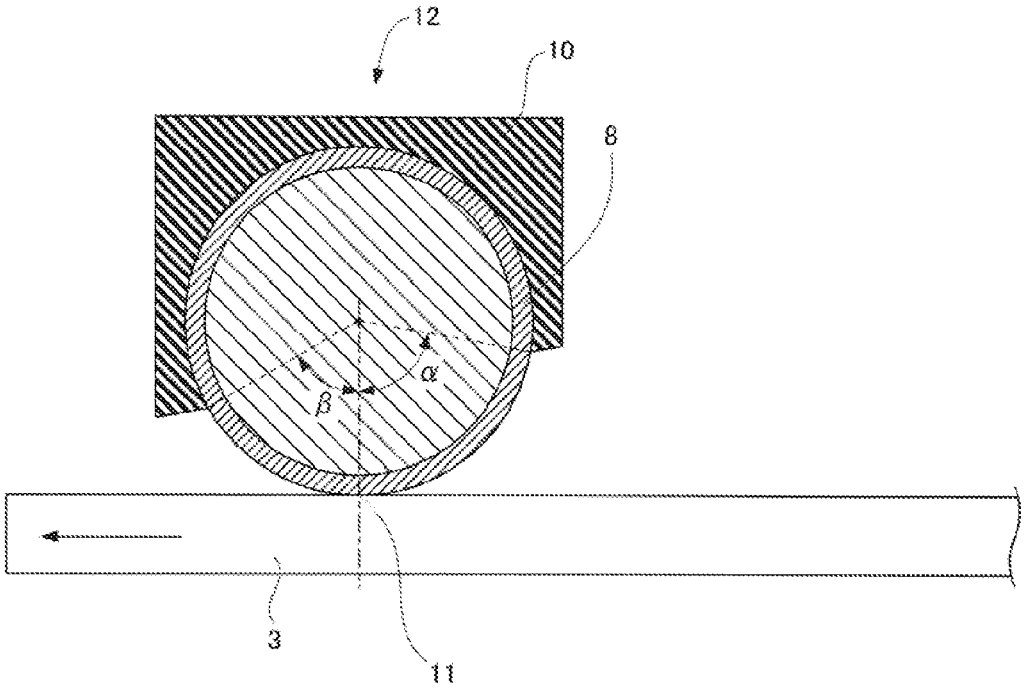
FIG. 3A is a schematic diagram illustrating the shape of a coating bar covered with resin according to a second embodiment.
Figure 3B:
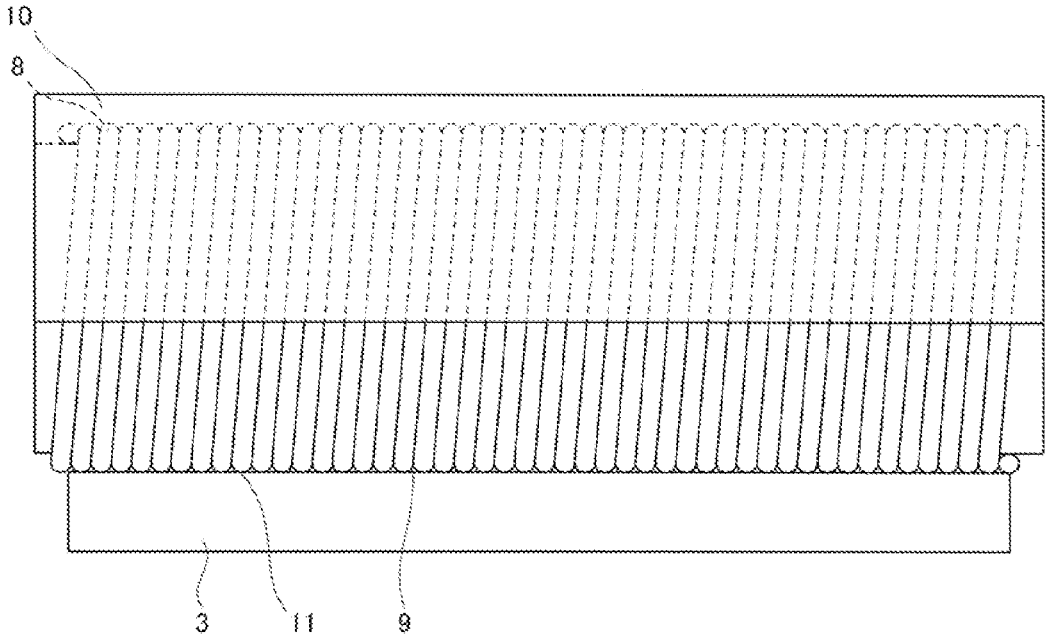
FIG. 3B is a schematic diagram illustrating the shape of the coating bar covered with the resin according to the second embodiment.
Figure 4A:
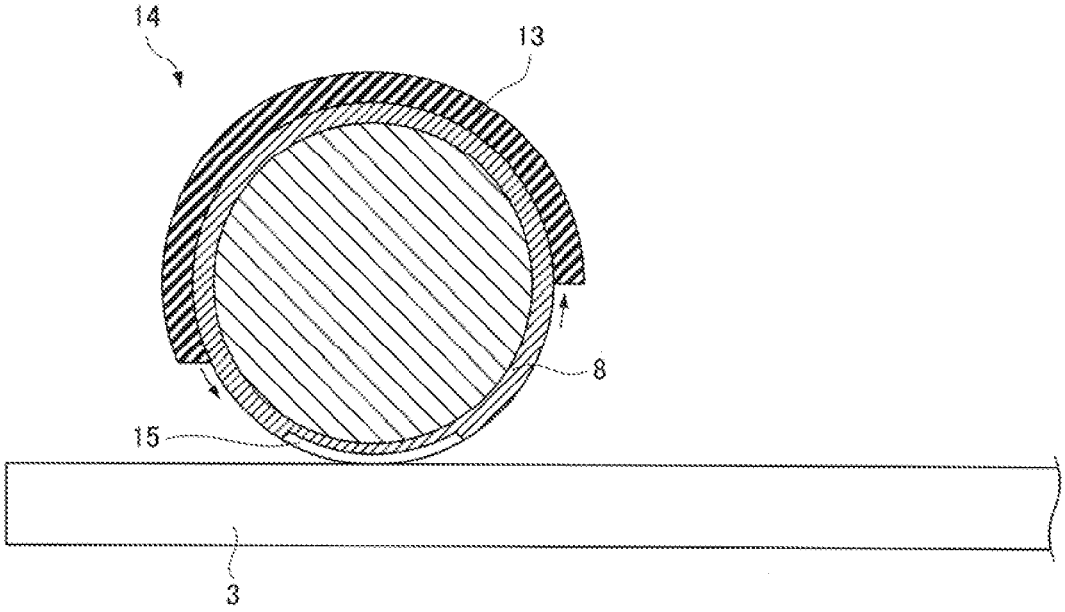
FIG. 4A is a schematic diagram illustrating the shape of a coating bar covered with rubber according to the second embodiment.
Figure 4B:
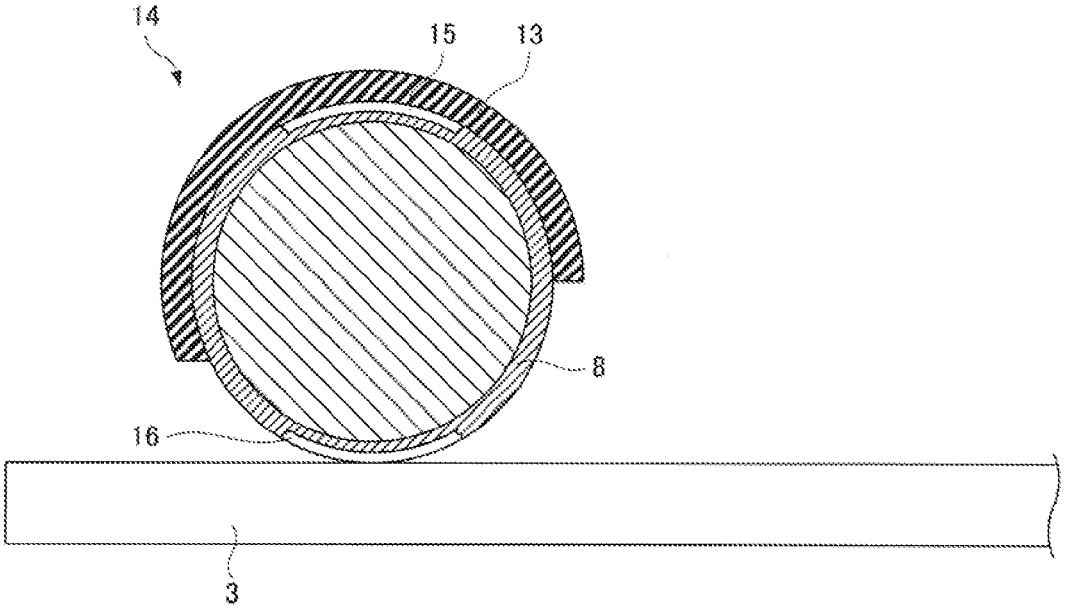
FIG. 4B is a schematic diagram illustrating the shape of the coating bar covered with the rubber according to the second embodiment.

FIGS. 3A and 3B are schematic diagrams illustrating the shape of the coating bar covered with resin according to the second embodiment. FIG. 3A is a cross-sectional view, and FIG. 3B is a side view. FIGS. 4A and 4B are schematic diagrams illustrating the shape of the coating bar covered with rubber according to the second embodiment. FIG. 4A is a cross-sectional view showing an initial state. FIG. 4B is a cross-sectional view showing a state after the rubber is moved.

Referring to FIGS. 3A and 3B, the structure and forming method of the coating bar will be described below. The coating bar is provided with grooves partially formed on the surface of the coating bar as in the first embodiment.

A coating bar 12 according to the second embodiment has a wire 8 that is wound around the outer surface of a substrate 3 and is coated with resin 10 partially covering the wire 8 over the width of the coating bar 12. The wire 8 of the coating bar 12 and the substrate 3 are in contact with each other in a region where the wire 8 is exposed from the resin 10 without being coated with the resin 10. The wire 8 is substantially circular in cross section and has a predetermined diameter.

As has been discussed, the wire 8 is exposed in the region where the wire 8 is not coated with the resin 10. Gaps 9 on the wire 8 have the same effect as the grooves 2 of the first embodiment (see FIGS. 1A and 1B). As in the first embodiment, the resin 10 is not provided in a region from a contact point between the coating bar 12 and the substrate 3 in the relative traveling direction (upstream) of the coating bar 12 (the range of an angle α in FIG. 3A) and a region from the contact point between the coating bar 12 and the substrate 3 in a direction opposite to the relative traveling direction (downstream) of the coating bar 12 (the range of an angle β in FIG. 3A). As in the first embodiment, a coating liquid contains a material that forms an antireflective coating after drying and burning, a prime solvent is a solution containing a solvent having a viscosity of 2 mPa·s to 10 mPa·s, and the coating bar 12 in contact with the substrate 3 on the contact point of the coating bar is drawn with a coating speed, that is, a constant relative traveling speed of 10 mm/s to 50 mm/s between the coating bar 12 and the substrate 3. In this case, the angle α is desirably 90° to 120° while the angle β is desirably larger than 0° and is equal to or smaller than 60°.

A material selected as the used resin 10 needs to be resistant to corrosion against an applied coating liquid.

As has been discussed, the coating bar 12 of the coating apparatus includes the wire 8 wound around the surface of the cylindrical shaft, and the resin 10 provided so as to open a region from the contact point between the coating bar 12 and the substrate 3 in the relative traveling direction of the coated substrate 3 and in the direction opposite to the relative traveling direction, thereby exposing the gaps 9 on the wire 8. Hence, the resin 10 suppresses an overflow of the coating liquid so as to prevent an overflow of the coating liquid or a liquid pool from causing variations in the thickness of a coating film or uneven coating. This allows the curved or wavy substrate 3 having high rigidity to be stably coated with a uniform film.

Even in the case where the coating bar is reduced in diameter to further track the substrate, an overflow of the coating liquid can be prevented. Furthermore, the winding of the wire 8 and the formation of the resin 10 are easier than the formation of grooves on the shaft, thereby easily applying a uniform film at low cost without causing uneven coating.

As illustrated in FIGS. 4A and 4B, the resin 10 may be replaced with elastic rubber 13 bonded so as to cover the gaps 9 on the wire 8 (see FIGS. 3A and 3B). In this case, the rubber 13 on the coating bar 14 can be shifted so as to shift a contact point 11 on the substrate 3. Specifically, in the case where a surface 15 of the wire 8 wears on the contact point 11 on the substrate 3 after a predetermined number of times of coating (a state in FIG. 4A), the rubber can be slightly shifted to expose another surface 16 of the wire 8 (a state in FIG. 4B) as the contact point 11 (see FIGS. 3A and 3B) for use. Hence, the life of the coating bar 14 can be extended while lower running cost for equipment can be expected.

Figure 5A:
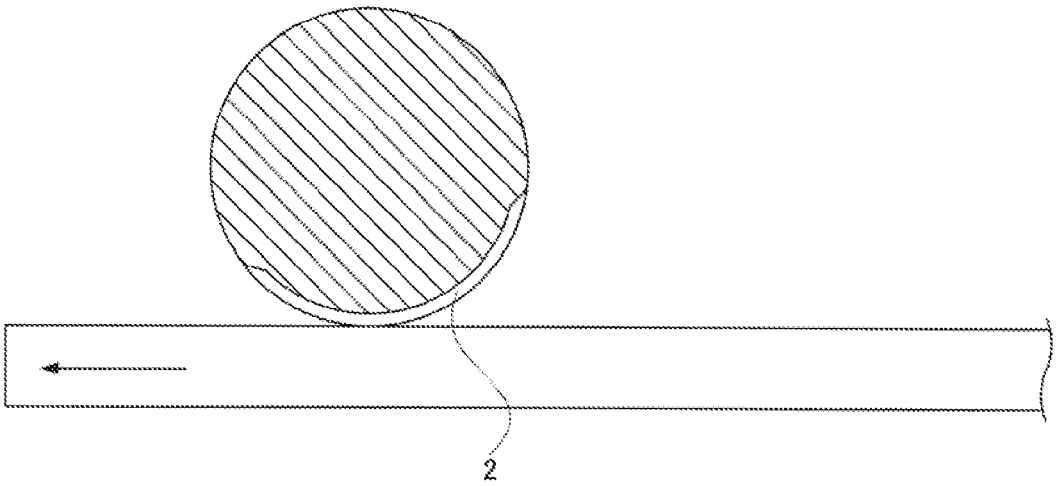
FIG. 5A illustrates the shape of a groove end according to the present invention.
Figure 5B:
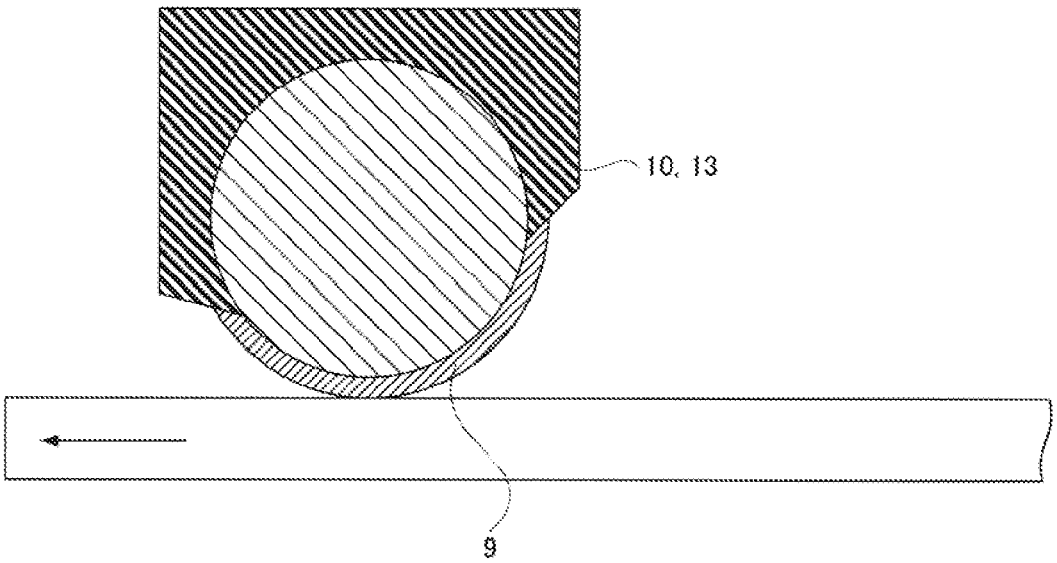
FIG. 5B illustrates the shape of a groove end according to the present invention.
Figure 6:
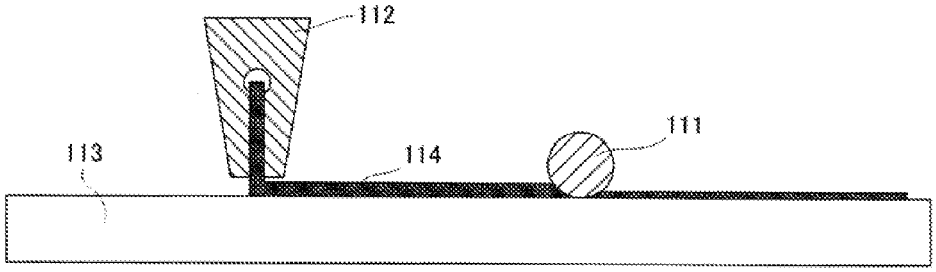
FIG. 6 PRIOR ART
FIG. 6 is a schematic diagram for explaining a conventional bar-coating method.
Figure 7A:
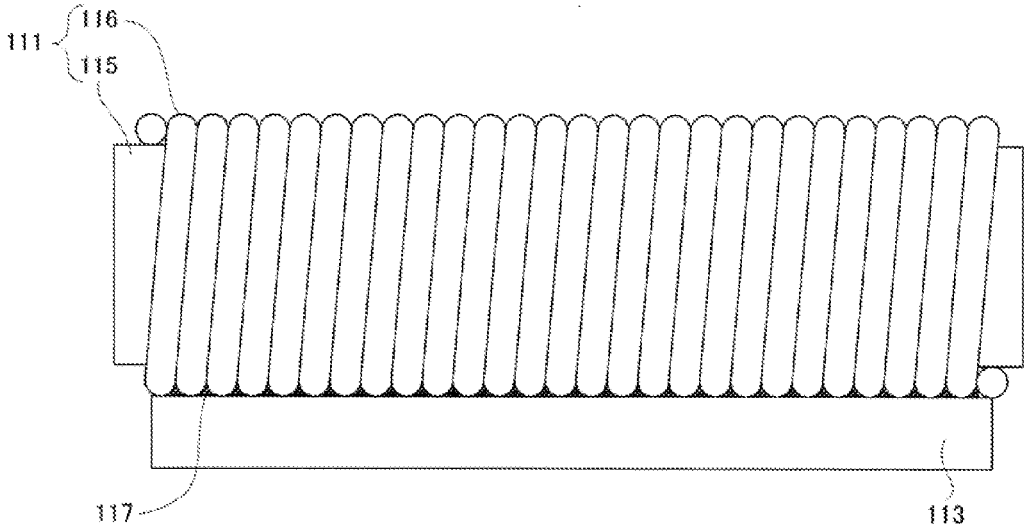
FIG. 7A PRIOR ART
FIG. 7A is a schematic diagram illustrating the structure of a conventional bar.
Figure 7B:
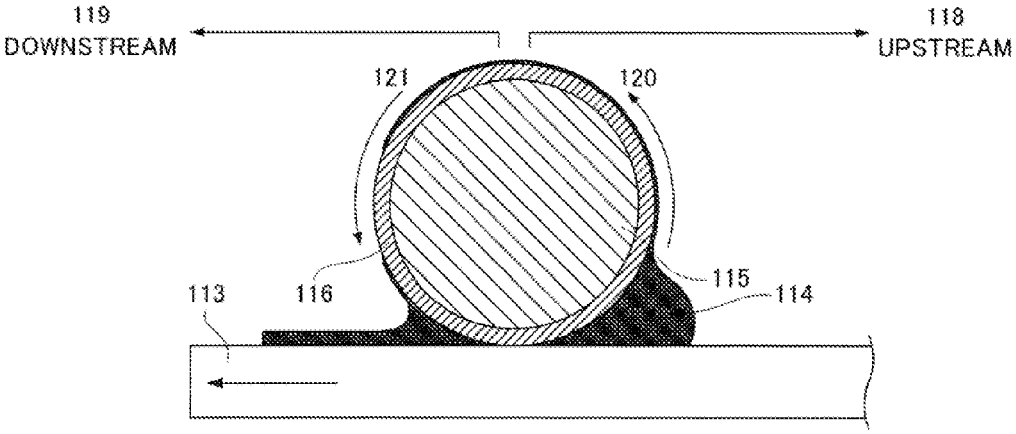
FIG. 7B PRIOR ART
FIG. 7B is a schematic diagram illustrating the structure of the conventional bar.

As illustrated in FIGS. 5A and 5B, the coating bars according to the first embodiment and the second embodiment may have a tilted end in the groove or exposed gap. FIGS. 5A and 5B illustrate the shape of a groove end according to the present invention. FIG. 5A illustrates the shape of the groove while FIG. 5B illustrates the shape of a groove formed in a gap.

As illustrated in FIG. 5A, the end region of a groove 2 decreases in depth toward the end of the groove 2. As illustrated in FIG. 5B, the resin 10 or the rubber 13 is provided such that the end region of the gap 9 formed on the wire decreases in depth toward the end of the gap 9. Since the end of the groove 2 or the gap 9 gradually decreases in depth, air bubbles in a coating liquid 4 are easily released and the protrusion of the coating liquid 4 is suppressed, thereby stably applying a uniform film.

What is claimed is:

1. A coating bar comprising a cylindrical body drawn to spread a coating liquid in a scraping manner on a substrate to be coated with a thin film, wherein the coating bar comprises a plurality of grooves extending linearly in a circumferential direction on a surface of the cylindrical body over a coating width, each of the grooves is shorter than a circumference of the cylindrical body in cross section, and a groove non-forming region is between one end of the groove and another end of the groove, and each of the grooves extends in a direction orthogonal to a longitudinal axis of the cylindrical body along the entire length of the grooves.

2. The coating bar according to claim 1, wherein the grooves are defined by:

a wire circular in cross section, wrapped around a cylindrical core; and a coating material partially covering gaps between turns of the wire by partially coating the wire, and a region exposed from the coating material in the gaps serves as the groove.

3. The coating bar according to claim 2, wherein the coating material is one of resin and rubber.

4. The coating bar according to claim 2, wherein the coating material is rubber and moves on the surface of the cylindrical body in a circumferential direction of a circular section of the cylindrical body.

5. The coating bar according to claim 1, wherein the cylindrical body has a diameter of 2 mm to 6 mm in cross section.

6. The coating bar according to claim 2, wherein the cylindrical body has a diameter of 2 mm to 6 mm in cross section.

7. The coating bar according to claim 1, wherein the groove has one end from 90° to 120° in a first direction and an other end from an angle larger than 0° to 60° in a second direction opposite to the first direction, with respect to a straight line connecting an axis of the cylindrical body to a contact point on the surface of the cylindrical body that comes into contact with the substrate when the cylindrical body is drawn.

8. The coating bar according to claim 2, wherein the groove has one end from 90° to 120° in a first direction and an other end from an angle larger than 0° to 60° in a second direction opposite to the first direction, with respect to a straight line connecting an axis of the cylindrical body to a contact point on the surface of the cylindrical body that comes into contact with the substrate when the cylindrical body is drawn.

9. The coating bar according to claim 1, wherein in an end region of the groove, the groove decreases in depth toward an end of the groove.

10. A coating apparatus comprising:

a substrate holding stage that holds a substrate;

a dispenser mechanism that supplies a coating liquid onto the substrate in a width direction of the substrate; and the coating bar according to claim 1, wherein the coating bar does not rotate the cylindrical body and comes into contact with the substrate only on a specific contact point located on a space between the grooves on an outer surface of the cylindrical body.

* * * * *